US006192948B1

(12) United States Patent
Claessens et al.

(10) Patent No.: US 6,192,948 B1
(45) Date of Patent: Feb. 27, 2001

(54) TEAR-OPEN SPOUT FOR A CONTAINER

(75) Inventors: Albert Louis Victor Jozef Claessens, Houthalen (BE); Austin McDonald, Raritan, NJ (US); Gerhard Liepold, Watchung, NJ (US); Donald Stollenmaier, Morristown, NJ (US)

(73) Assignee: Duras Trading Limited (IE)

( * ) Notice: Subject to any disclaimer, the term of this patent is extended or adjusted under 35 U.S.C. 154(b) by 0 days.

(21) Appl. No.: 09/355,819

(22) PCT Filed: Feb. 4, 1998

(86) PCT No.: PCT/IE98/00006

§ 371 Date: Sep. 3, 1999

§ 102(e) Date: Sep. 3, 1999

(87) PCT Pub. No.: WO98/33719

PCT Pub. Date: Aug. 6, 1998

(30) Foreign Application Priority Data

Feb. 4, 1997 (IE) ..... S970068

(51) Int. Cl.[7] ..... B65B 1/04; B65B 3/00; B67C 3/00

(52) U.S. Cl. ..... 141/383; 141/69; 141/85; 141/94; 141/329; 141/348; 141/349; 141/350; 141/360; 141/386; 215/215; 215/250; 215/253; 215/255; 220/284

(58) Field of Search ..... 141/69, 85, 94, 141/328–330, 348–351, 360, 383, 386; 215/211, 215, 250, 253, 255, 295; 220/266, 284

(56) References Cited

U.S. PATENT DOCUMENTS

| | | | |
|---|---|---|---|
| 4,355,729 | 10/1982 | Maguire . | |
| 4,903,855 | 2/1990 | Ducay . | |
| 5,056,659 * | 10/1991 | Howes et al. | 206/217 |

FOREIGN PATENT DOCUMENTS

| | | |
|---|---|---|
| 546400 | 4/1956 | (BE) . |
| 688534 | 3/1953 | (GB) . |
| 89/07575 | 8/1989 | (WO) . |
| 96/21615 | 7/1996 | (WO) . |

* cited by examiner

*Primary Examiner*—Timothy L. Maust
(74) *Attorney, Agent, or Firm*—Ostrolenk, Faber, Gerb & Soffen, LLP

(57) ABSTRACT

A closure for a transportable container used in the transfer of materials to or from an enclosed process area is described. The container docks with a port in a wall of the process area forming a sealed connecting chamber which is sterilized by irradiation. Communication between the interiors of the container and the process area is then established. The closure has a collar and a lid, which portions are formed so that all the surfaces which form part of the connecting chamber in use are in the direct line of the sterilizing radiation, which is normally ultra-violet or pulsed white light radiation. No relevant surface is shadowed from the radiation. The lid may be formed integrally with the collar with a thin web separating the two to define a fracture line. The lid is provided with a grip which can be grasped from within the process area. Application of a pulling force to the grip causes the lid to be pealed away from the collar without the generation of particulates.

15 Claims, 6 Drawing Sheets

Ø 3.996
Ø 3.803

.283
45°
120°
.050
3.040
.098
Ø 4.398
88.50°
88°
15°
2.737
2.915
1.113
R 1/8
.138
Ø 4.557
Ø 5.512

34
35
10
32
10
36
31
21
251
250
5
C
4

TEAR-OPEN SPOUT FOR A CONTAINER

BACKGROUND OF THE INVENTION

The present invention relates to a closure for a container used in the transfer of materials or components between a contained isolation or clean-room process area and a non-sterile outside environment.

Transfers of sterilised materials between sterile or clean areas via the outside environment are routinely made in industries such as the pharmaceuticals, medical devices, biotechnology and food industries. Typically, a container or bag, the interior of which is sterile, is offered up to and coupled with a port in a wall of the process area. After conducting a sterilising cycle to sterilise the interface between the container and the port, a door in the port is opened to permit an operator located within the process area to gain access to the container and to remove a cap or lid from the container, thereby enabling the sterile interior of the container to be charged with sterile materials, or to permit sterile materials to be unloaded from the container into the process area.

Typically, the cap or lid of the container comprises a flexible foil which is sealed over the mouth of an opening provided in the container. The operator may remove the foil manually by punching it to rupture the foil, then pushing the broken foil pieces toward the rim or mouth to provide free access to the container interior via the mouth. Alternatively, the operator may use a sharp instrument to cut through the foil. Both methods are likely to generate some non-viable particulate material, which may enter the process area, contrary to good manufacturing practice codes in these industries. Both methods are also susceptible to causing perforation to be made in the operator's gloves, which could introduce viable particulate into the system, compromising the cleanliness of the process area. To avoid these problems, the foil may be provided with a tab which can be grasped by the operator to assist him in peeling the foil, in an unbroken state, from the container mouth. In such cases, care must be taken to ensure that whichever sterilizing means is used to sterilize the interface between the coupled container and dock is effective to sterilize all surfaces of the tab.

An effective coupling assembly for a container and a port is disclosed in WO96/21615 and comprises a collar of substantially tubular shape which docks with the port of a process area. The collar forms part of a transportable container. The port includes a door which opens inwardly into the process area. To the exterior facing side of the door are mounted ultraviolet (UV) or pulsed white light emitting sources which emit radiation at a frequency effective for sterilisation. On docking of the collar and port, a sealed chamber is established between the port and the collar and this chamber is sterilize by activation of the UV or pulsed white light lamps for a sufficient amount of time. Thereafter, the port door is opened and a foil covering the mouth of the collar can be removed to enable materials or components to be transferred between the container and process area. It will be appreciated that the foil will have a pull tab to facilitate its removal and that it is a matter of some difficulty to arrange the tab in such a way as to ensure that none of its surfaces are shadowed from the sterilizing radiation. Such shadowing may occur as illustrated in prior art Figure A, which shows a peel-off foil F covering the mouth M of the collar C of a container (not shown). The foil F is sealed to the mouth M by glue G. The foil F overlaps the mouth M at O, the overlap providing a grippable area which an operator can grasp to remove the foil F. However, it will be appreciated that while the upper surface F' of the foil lies in the direct line of the sterilising radiation (shown by the arrows), the underside surface F" of the overlapped portion is shadowed from the sterilising radiation by the foil F itself and this area constitutes a potential source of viable contamination of the entire process area once the foil has been peeled away.

SUMMARY OF THE INVENTION

The present invention seeks to overcome the above described disadvantages of heretofore used foils or seals and to provide an improved seal in which the risk of contamination is minimised. In particular, a seal which is especially suitable for use with the assembly described is WO 95/21615, is provided.

Accordingly the present invention provides a closure for a transportable container usable in the transfer of materials to or from a sterile or clean process area via a non-sterile environment, the closure being dockable with a port located in a wall of the process area to form a sealed connecting chamber, the closure comprising a collar portion arranged to lock with the port and a lid portion which is removably connected to the collar portion, the arrangement being such that following locking of the closure with the port and sterilization of the sealed connecting chamber, the lid portion is removable from within the process area to provide communication between the interiors of the container and the process area, the collar and lid portions being so formed and shaped that all surfaces thereof which form part of the sealed connecting chamber lie in use in the direct path of sterilising ultra-violet or pulsed white light radiation generated within the chamber with no surface or portion of a surface being shadowed from the radiation, characterised in that the lid portion includes a grip member grippable to assist in the removal of the lid portion from the collar portion without the generation of particulate material and in that all external surfaces of the grip member lie in use in the direct path of the sterilizing radiation. The lid portion may be bonded to or integrally formed with the collar portion and may be fabricated from plastics material by injection moulding or other suitable means.

In a preferred arrangement, the junction between the lid and collar portions comprises a thin, frangible web or material defining a fracture line between the two portions and the grip member is disposed so that when it is pulled in a direction away from the collar portion, the web or material is caused to break along the fracture line to release the lid portion from the collar portion.

The collar portion may be formed with an exterior surface which tapers towards the junction with the lid portion and the tapering surface may continue over and beyond the junction by the provision of a matching taper on the outer surface of the rim of the lid portion. Conveniently, the lid portion has a planar surface which covers the mouth of the collar and which faces the port in use, and the grip member is associated with the planar surface. In a preferred arrangement, the grip member is disposed about at least a portion of the rim of the lid portion. Most conveniently, the grip member is substantially triangular in cross-section, one side of the triangle comprising a tapered outer surface of the lid rim.

The collar is conveniently provided with a flange which is sealingly connectable to a surface of the container and the flange extends radially outwardly from the collar portion. Most conveniently, the flange is formed integrally with the collar portion. In a preferred arrangement, the flange has a planar surface which is sealingly connectable to a planar surface of the container. The surface of the flange which is connected to the container may be blat or sloped. The attachment of the surfaces of the container and collar may be made by any suitable means capable of providing a strong seal between the two, for example, by adhesive or by welding.

The closure may include a sensor means connectable with a sensory device provided in the port.

The invention also provides a transportable container having a closure as described above.

One embodiment of a seal according to the invention will now be described with reference to the accompanying drawings, in which:

DESCRIPTION OF A PREFERRED EMBODIMENT

Figure 2:
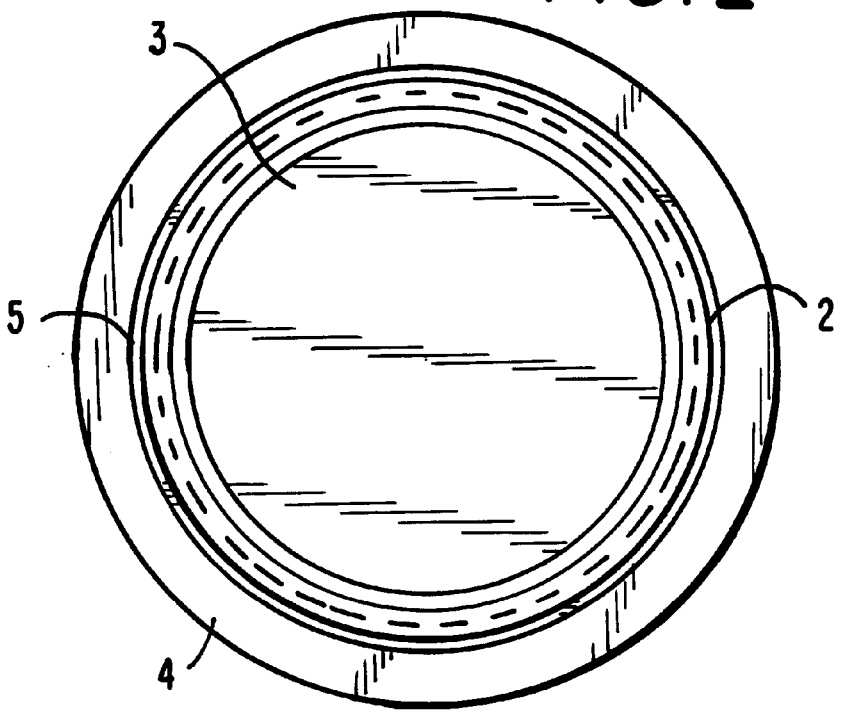
FIG. 2 is a view from below of the closure of FIG. 1.
Figure 1:
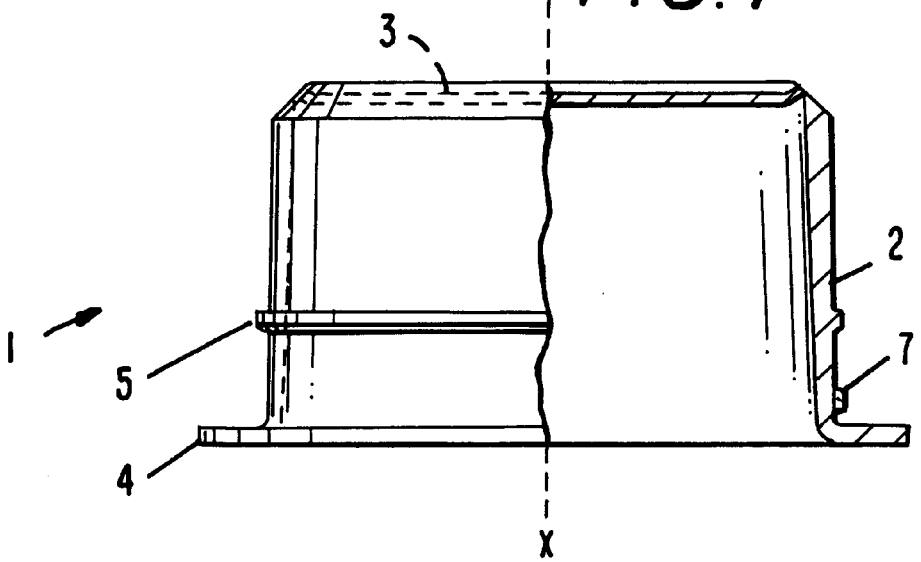
FIG. 1 is a partially sectional side view of a closure for a transportable container according to the invention.

Referring initially to FIGS. 1 to 4, the closure 1 comprises a collar 2 and a seal 3. At the base of the collar 2 is provided a circumferentially and radially outwardly extending flange 4, under or over which a container (not shown) can be sealingly fixed. The container may be flexible or otherwise. The container, collar and seal comprise together a sterilizable transportable system usable for transporting sterile materials through an unsterile environment to or from a sterile or clean process area. Intermediate the flange 4 and seal 3, the collar 2 is provided on its exterior facing surface with a circumferentially extending projection 5, which serves to help prevent the disengagement of the closure 1 from a port of a process area after docking has been established, as will be described below with reference to FIGS. 5 and 6.

Figure 4:
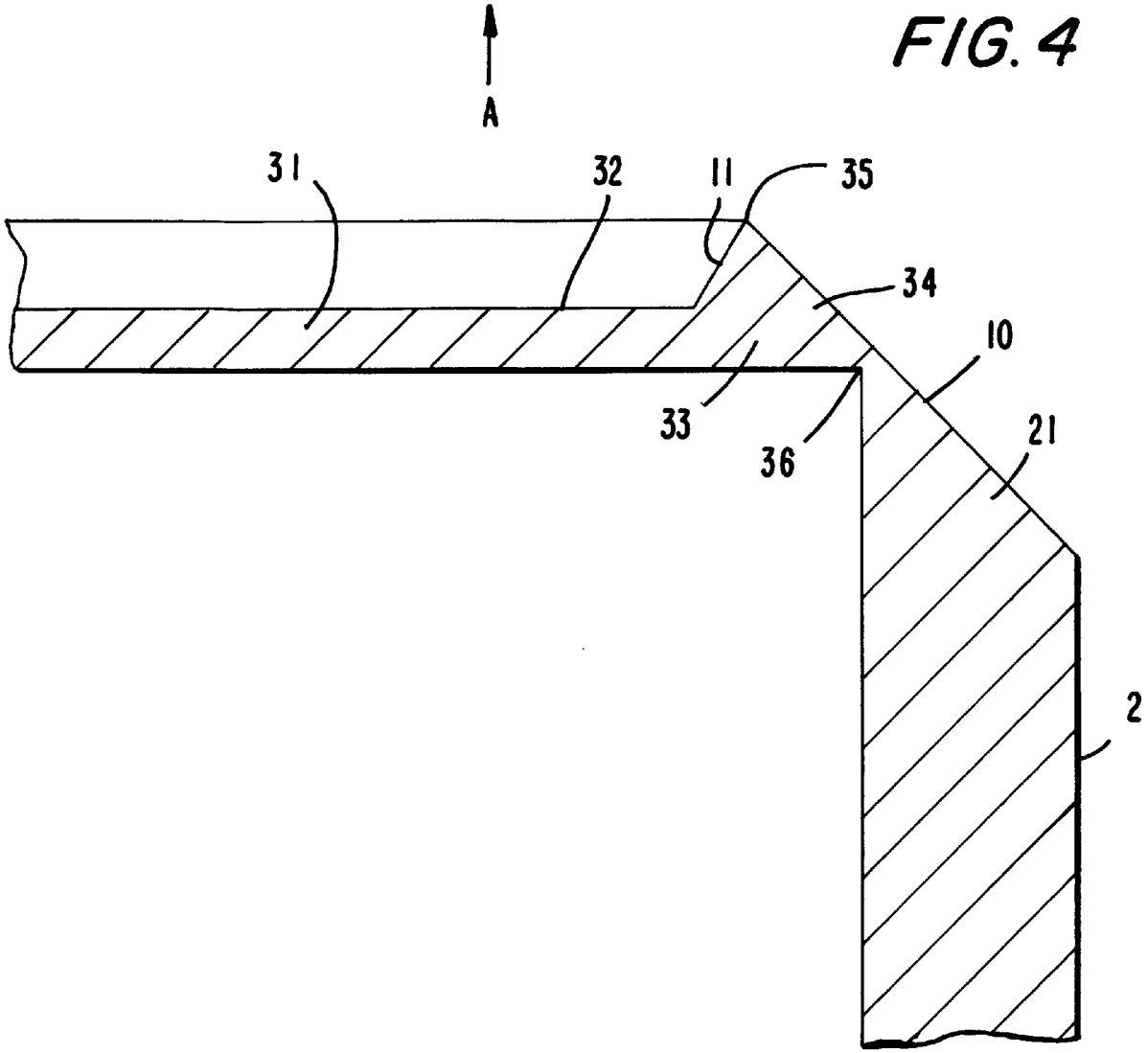
FIG. 4 is a detail view of the collar/lid junction of FIG. 1.

One embodiment of the seal 3 and its junction with the collar 2 will now be described with particular reference to FIG. 4. Seal 3 comprises a lid 31 having a flat surface 32 which faces the port during docking. The rim 33 of the lid 31 is formed integrally and continually with the upper wall portion 21 of the collar 2. The junction 36 between wall 21 and lid 31 is formed, on its outwardly facing side, as a frustoconical surface 10 tapering towards the apex 35 of a grippable ridge 34 of the lid 31. Ridge 34 is formed about the circumferential of the lid surface 32 and stands proud of the rim 33. The surface 11 of the inside wall of ridge 34 tapers from surface 32 toward the apex 35.

Due to the frustoconical taper of surface 10, part of which is provided by a tapering reduction in thickness of the upper portion of collar wall 21 and the remainder of which is provided by a tapering reduction in thickness of rim 33, a relatively thin-walled junction 36 is formed between collar 2 and lid 31. This junction 36 represents a point of weakness or a fracture line (36) which can be exploited to enable the lid 31 to be torn from the collar 2. This is achieved by applying a double jawed gripping tool (FIG. 7) to the ridge 34 so as to engage one jaw of the tool against the outwardly facing sloping surface 10 of the ridge 34 and the second jaw against the inwardly facing sloping surface 11 of the ridge 34. To facilitate gripping, the jaws are preferably toothed. Then, by applying a force to the tool in the direction of the arrow A (FIG. 4), the thin wall at junction 36 is ruptured by the jaws. The lid 31 may then be removed intact by peeling it away from the collar 2, rupturing along the fracture line formed by the thin wall.

Figure 3:
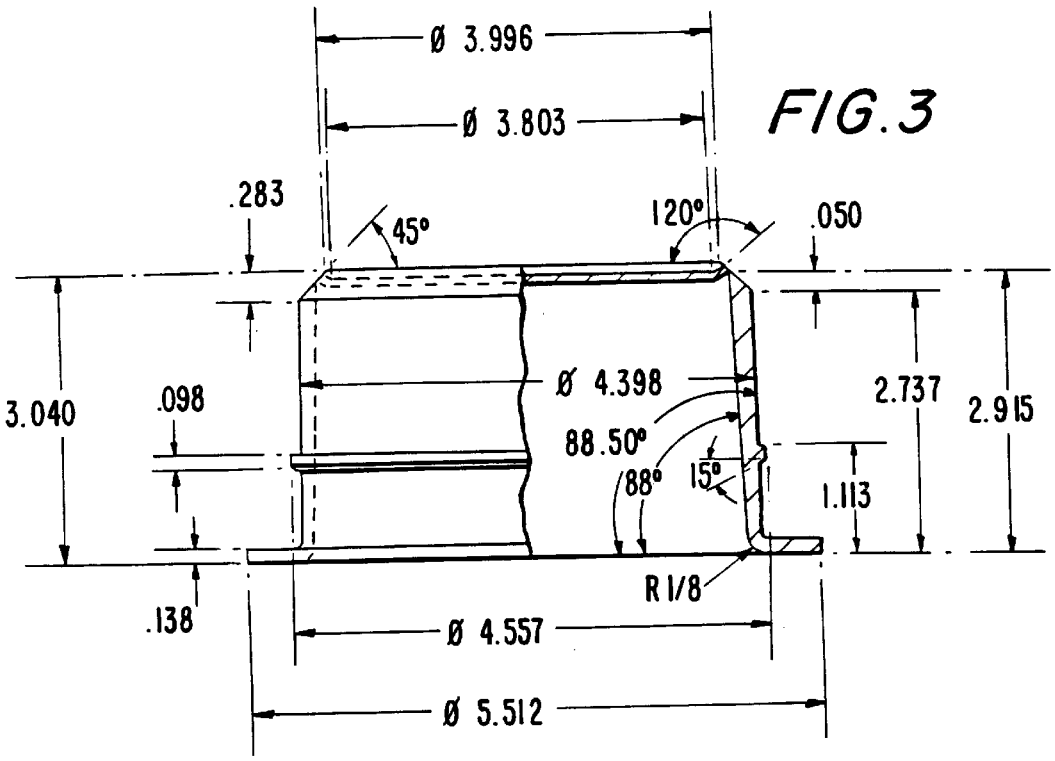
FIG. 3 is a view identical to FIG. 1, showing one set of suitable dimensions for the parts.

As shown in FIG. 3, one suitable arrangement of the ridge 34 is where the angle between the frustoconical surface 10 and the surface 32 is 45° . Other suitable dimensions for one arrangement of the collar are also shown in the Figure. and it is to be understood that these dimensions are exemplary in nature and not to be in any way considered as limiting.

Figure 6:
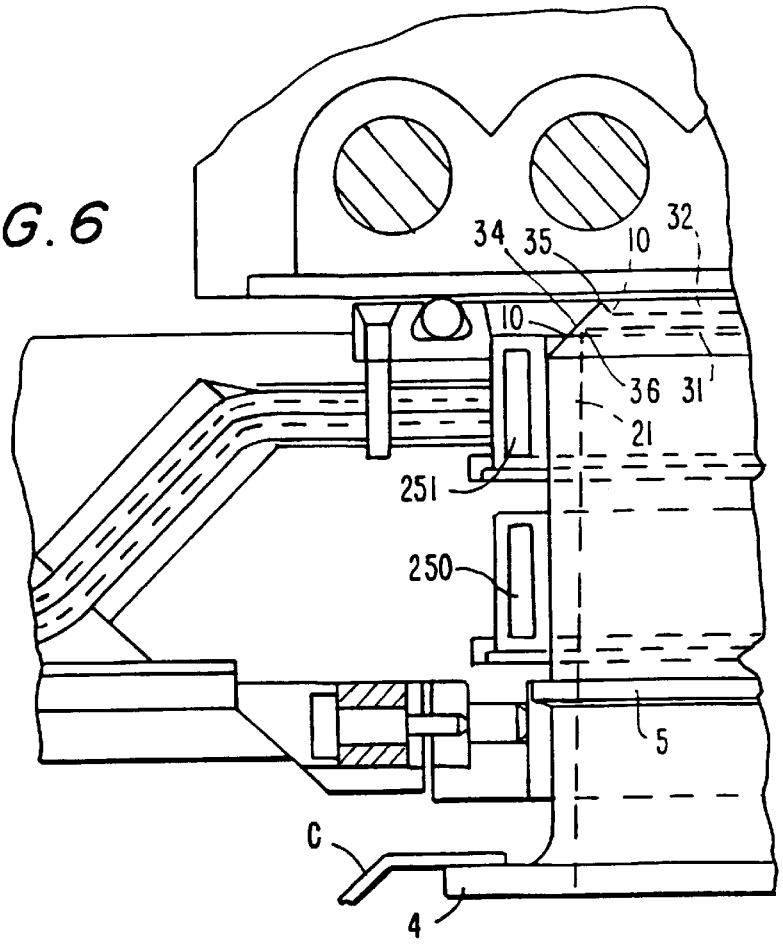
FIG. 6 is a detail view of a section of FIG. 5, showing more clearly the position of the collar.
Figure 5:
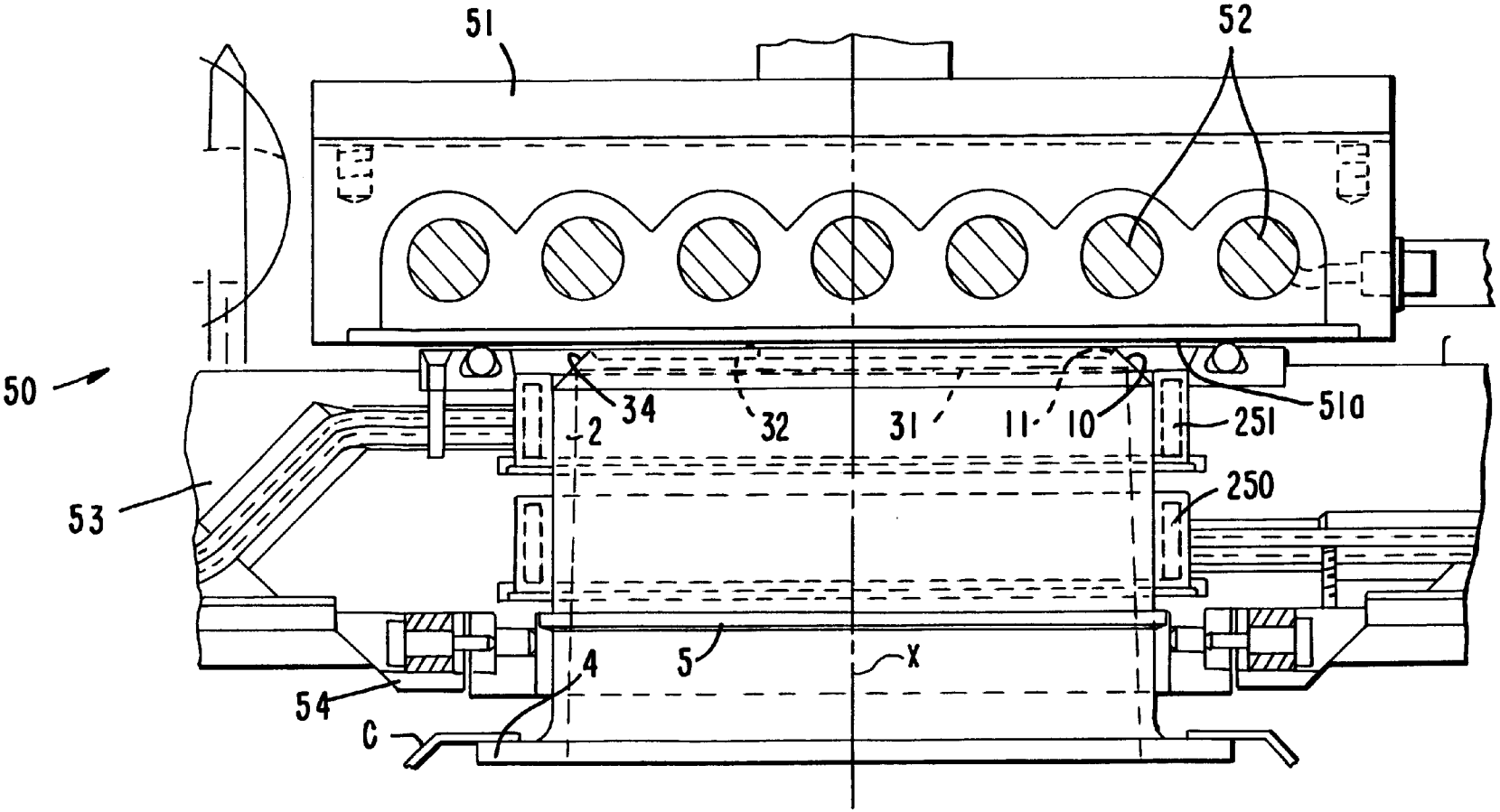
FIG. 5 is a view showing the docking of the closure of FIG. 1 with a port of a process area.

FIGS. 5 and 6 demonstrate the docking of the assembly 1 with a port such as that described in WO96/21615. Port 50 is fully described in that document and accordingly will now be described only insofar as necessary to convey a full appreciation of the invention disclosed herein. Accordingly, port 50 includes a door 51, shown closed in FIGS. 5 and 6. On the outwardly facing side 51*a* of the door are mounted seven UV lamps 52. Sleeve 53 of the port 50 is adapted to receive the collar 2 and to lock it into position coupled with the port shown in FIGS. 5 and 6.

A locking mechanism, generally indicated by numeral 54 is actuable to engage the external surface of the collar wall 2 between projection 5 and flange 4, to retain the collar 2 in place and to prevent it from accidentally disengaging from the port 50 during a transfer. As the projection 5 extends around the entire outer circumference of the collar 2, it will be appreciated that there is no need to offer up the collar 2 to the port 50 in any particular rotation about the longitudinal axis x of the collar (FIG. 1) and this feature allows for easy and speedy establishment of docking between the collar 2 and port 50.

Once docking of the collar 2 with sleeve 53 has been achieved and verified by the display of a "ready" message on a connected programmable logic controller, various seals are actuated to bear between the exterior of the collar 2 and the interior of the port 50, thus forming a sealed connection chamber 55 between the mouth area of the collar 2, the exterior of the lid 31 and the door 51 of the port 50. First, the secondary environmental seal 250 is inflated, sealing the transfer interface. The pressure in the secondary seal is verified as correct according to specification and constant. Next, the UV lamps 52 are activated to sterilize the vertical contact surface between the primary environmental seal 251 and the horizontal interface surface of collar 2, including lid 31. After a predetermined time and with the UV lamps 52 remaining activated, the primary environmental seal 251 is inflated. Irradiation is continued for a predetermined period of time sufficient to sterilise the volume enclosed by the chamber 55, together with the exposed surfaces of the port 50, collar 2, primary environmental seal 251 and lid 31, to achieve a reduction of contaminants by at least a factor of $10^{-6}$. After the sterilization cycle is complete, door 51 may be safely opened inwardly into the process areas. It will be appreciated that all surfaces which form part of the chamber 55 are directly exposed in the path of the UV radiation generated by lamps 52 and no potentially contaminated surfaces of the sleeve 53, door 51, collar 2, or lid 31 which become continuous with the process area on opening of the door 51 are shadowed from the sterilizing radiation. The tapering surfaces 10, 11 and the lid surface 32 are so formed that all parts of the collar 2 receive the sterilizing radiation impacting directly on them. Although not shown so in the figures, the collar 2 may be formed so that its exterior facing wall tapers toward the upper wall portion 21, for example by a 2° slope. The slope in the wall of the collar would further facilitate the sterilisation of the surface of the exterior wall of collar 2.

Figure 7:
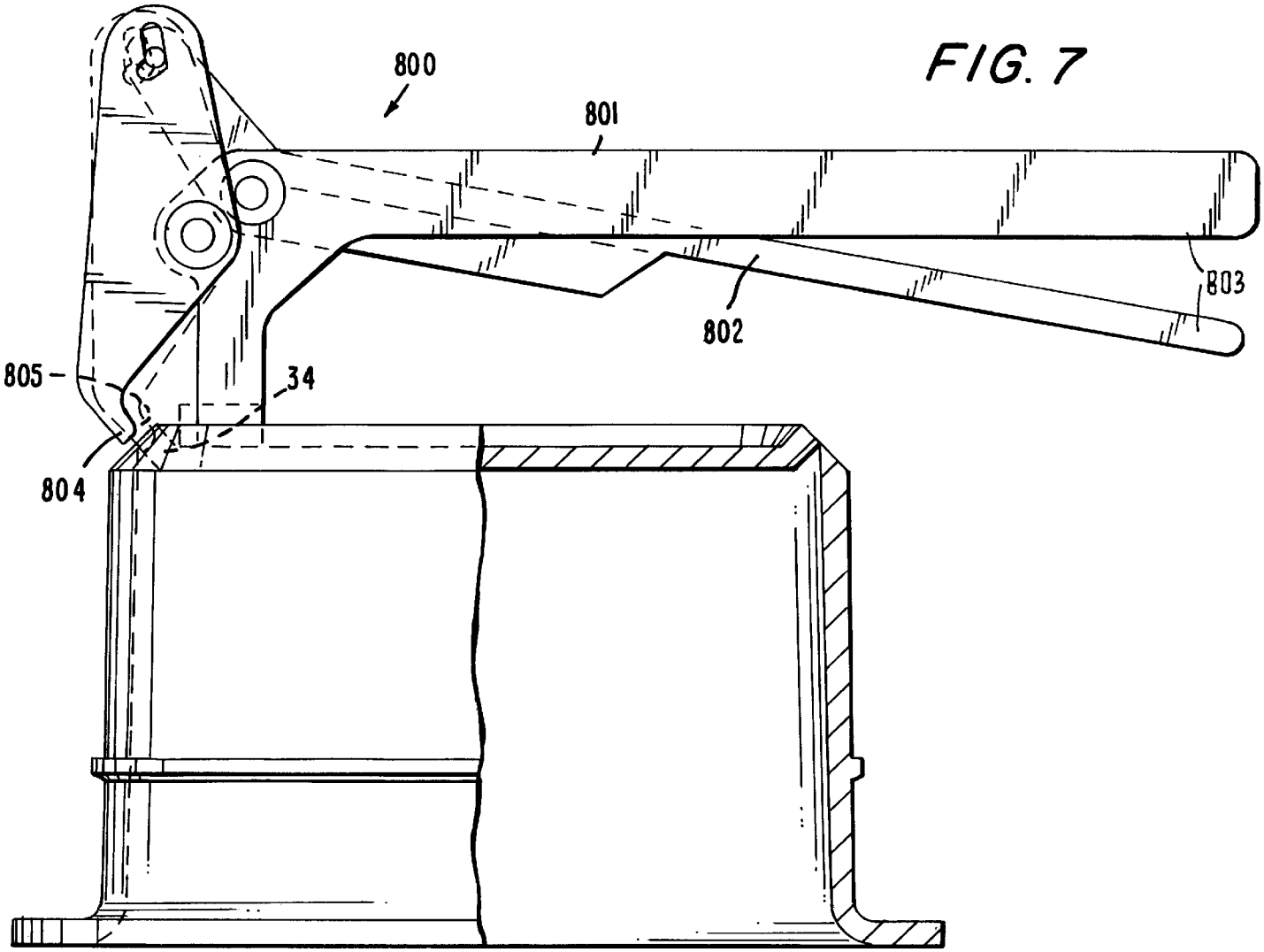
FIG. 7 is a partially sectional view of the closure of FIG. 1, showing a gripping tool for removing the lid.

Once door 51 is opened, an operator working within the process area may reach through with the gripping tool as shown in FIG. 7 and use it to grasp the ridge 34 anywhere about its circumferential length. Next, by pulling on the tool, the operator is enabled to break the lid 31 from the collar as described above, to remove it completely from the collar and to withdraw it into the process area. The lid 31 thus may be cleanly removed without the generation of particulates. Free access between the interior of the container C sealed to the flange 4 of the collar is thereafter available.

A gripping tool suitable for removing the lid 31 is shown in FIG. 7. The tool 800 has a pair of legs 801, 802 each of which has a handle 803. Distal each handle 803 is a jaw, leg 801 having jaw 804 and leg 802 having jaw 805. The legs 801, 802 are pivoted together for relative movement. In use, jaw 805 bears against the inwardly sloping surface 11 of the ridge 34 and jaw 804 bears against the outwardly sloping surface of the ridge 34. When the jaws 804, 805 are pivoted toward one another, the force applied to the ridge 34 serves to break it at its weakest point, that is to say, at junction 36. Once the break has been made, the lid 31 may be peeled off with the jaws gripping the ridge.

The tool 800 may be operated manually or may be arranged for automatic operation. In the latter case, the tool 800 may be connected to the port of the clean, process enclosure area.

Regarding the attachment of the closure 1 to a container, this may advantageously be achieved by flat welding a planar surface of the container to a planar surface of the flange 4. This may be done automatically using a welding tool which has an unbroken welding surface shaped to match that of the face of the flange 4 to which the container is to be attached, resulting in a high quality, secure weld being formed. Such a weld enables checking for leaks between the container and the closure to be done by spot-checking randomly selected containers, rather than, as before, checking each individual container for leaks.

Formerly, it has been the practice to bring the container and closure together manually in preparation for welding these parts together. Generally, the container is a flexible bag with a mouth wider than the width of the closure. Thus, once the closure is inserted into the mouth, the material of the bag is gathered manually about the closure. The presence of the gathers makes it difficult to carry out the welding step using a single tool and a single weld, so that the weld must be made manually in a series of welding steps. The manual operation can vary from container to container and consequently verification of the weld and of the integrity of the resulting container can not be done on the basis of testing randomly selected containers. In consequences, each container must be checked for leaks at the interface between container material and the container closure and this places a high cost burden on the manufacture of such bags. Furthermore, the significant manual intervention required poses an unacceptably high risk of introduction of both viable and non-viable particulate contaminants.

By welding the closure to an orificed planar surface of the container, as described herein, the container manufacture in its totality can be performed under class 100 clean conditions. Both the manufacture of the container itself and the attachment of the container closure can be carried out automatically in-line. Operator intervention is minimal and hence, the introduction of viable and non-viable particulates is minimised and the costs associated with manual assembly are reduced. Additionally, significant savings are obtained by eliminating the need to check each final container for leaks.

Figure 8:
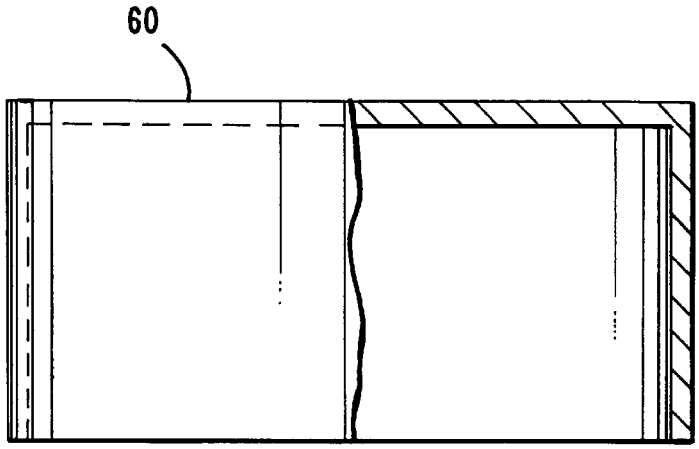
FIG. 8 is a partially sectional view of a cap for the closure.

FIG. 8 shows a modification of the collar 2 in which flange 41 is formed with sloped walls. The sloped walls of the flange 41 are suitable to receive the container connected thereto by a welding or other bonding process.

In the collar described above, it will be appreciated that the lid 31 is integrally formed with the walls of the collar and that no tab or other structure is present which could, in use when docked, be shadowed from the sterilizing radiation. Instead, the construction is such that all surfaces which become part of the process area on completion of the docking cycle are in the direct path of the sterilizing radiation. Furthermore, the lid covering the collar can easily be removed without generation of particulates.

The closure of the invention may equally be used in docking systems which use sterilising means in addition to or other than UV or pulsed white light, for example, in systems which use steam or sterilizing gases to sterilise the coupled port and container interface.

The lid and collar may be formed integrally, for example by injection or other moulding with suitable plastics materials. Equally, they may be bonded together with a suitably formed area of weakness to define the fracture line which can be easily breakable to enable separation of lid from collar, or may be formed in any other suitable way. Likewise, the lid may be formed wholly separately from the collar and be adapted to fit with the collar in some suitable way, such as by an interference or a screw fit. The arrangements in which the lid and collar are connected by being formed together, such as by bonding or by being integrally formed, are preferred, since containers using this preferred arrangement can readily be inspected to ensure that the connection between the lid and collar is unbroken and hence the sterile status of the interior of the container has not been intentionally or unintentionally compromised.

The grip or ridge of the lid may be formed with any other suitable profile other than the triangular cross-section shown in the drawings. For example, it may have a rounded or humped shape. It may also be formed about only a part of the rim of the lid, or may be positioned not on the circumference of the lid, but elsewhere on its surface, for example as a central stud.

Most advantageous is to provide the grip in such fashion that it is easily accessible from within the process area and that it may be used as easily by a left-handed as a right-handed operator. For this reason, it is particularly preferred that the grip be provided as a ridge extending about the entire rim of the lid, as this obviates any need to locate the collar in any particular rotation within the dock and accounts for its easy accessibility for left- and right-handed persons. It is important that when it is to be used with UV or pulsed white light sterilization, all the external surfaces of the collar and lid which become part of the sealed connecting chamber on docking of collar and port, are shaped to lie in the path of the sterilizing radiation and that none of these areas are shadowed from the sterilizing radiation so as to constitute actual or potential sources of contamination of the process area.

The lid and collar portions need not to be formed with a generally circular cross-sectional shape. Any other suitable shape, including square, rectangular, triangular, oval etc., may be selected. The circular shape is a particularly preferred arrangement since it avoids the need for the collar to be offered up to the port in any particular axial rotation.

Generally, the transportable container will be manufactured with the intact closure arranged about a discharge opening of the container, and a further opening provided elsewhere in the container to enable the container to be charged with materials or components. Once charged, the further opening will be sealed and the container subjected to sterilization. Only when the contents are to be withdrawn therefore, need the closure be interfered with to remove the lid and to enable the contents to be accessed from the interior of the process area.

The container may have one or more closures formed in it. One closure may be employed for aseptically charging a pre-sterilized container, then that closure would be sealed. A second closure may be provided to enable a portion of the contents of the bag to be discharged and third and further closures could be provided to allow remaining contents or portions thereof to be discharged at a later time or times.

In cases where the seal/lid is formed separately from the collar and engages with the collar by an interference, screw or other form of fit, then it will normally be desirable to provide a means of demonstrating to the end-user that no tampering has occurred to compromise the sterility of the interior of the container. This may be achieved by the use of an anti-tamper closure such as those commonly used in the art or by the simple use of a heat or radiation sensitive tape placed about and over the junction between the lid and collar. Since the interference fit lid can readily be removed and replaced, it offers the advantage that only a single opening need by provided in the container, the same opening being usable for charging, discharging and indeed, if desired, recharging the container. Thus, in appropriate cases, it will be appreciated that the container may readily be recycled.

Figure 9:
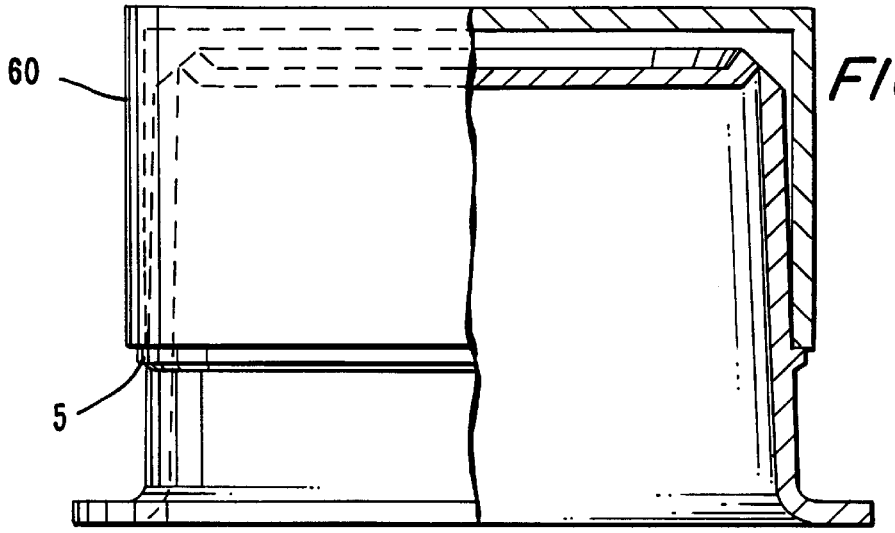
FIG. 9 is a partially sectional side view of the closure assembled with the cap.
Figure 10:
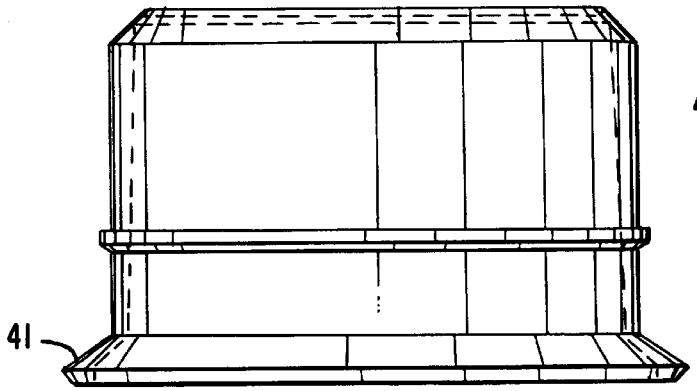
FIG. 10 is a view of a modified form of the closure of FIG. 1.

As shown in FIGS. 8 and 9, the collar is advantageously provided with a sealable cap 60 to protect the closure from mechanical damage, dust, and so on during transit and storage. The cap 60 would also serve to limit the biological burden on the collar parts which become exposed during a transfer and for this purpose, the cap 60 is designed to cover and protect those parts of the collar and lid which form part of the sterile connection chamber on docking of the container with the port of the sterile or clean room. In a preferred arrangement, the cap 60 is disposed to rest against the circumferentially extending projection 5, thus ensuring that the travel of the cap 60 over the closure 1 is limited and that the cap may not be pressed sufficiently over the collar so as to risk damaging the lid 31. The cap may be sealed to the collar with tape (not shown) or may be pressed over the collar as a snap-fit or both. The sealing tape may be of a heat or radiation sensitive type, depending on the sterilizing method employed to sterilize the container so that an operator can tell at a glance that the sealed container has undergone a sterilisation cycle. Clearly, those parts of the apparatus under the cap will be sterilised during the sterilization cycle. Additionally, the cap may be provided with a panel of a material which is porous to gas, such as sterilizing steam, but impervious to biological contaminants and which would therefore allow gas generated during sterilization to be vented from the interior of the container. One suitable material for this purpose is Tyvec (Trade Mark).

It is further to be understood that the collar may be provided with a sensor co-operable with sensing means which may be provided in the port of the process area. Such a sensor 7 could provide a number of functions, including but not limited to enabling the operator to ensure that the collar is correctly engaged in the port and the accumulation of tracking records, for example by enabling a record of which individually coded containers and which number of containers have been processed via a particular port to be kept.

It will of course be understood that the invention is not limited to the specific details described herein, which are given by way of example only, and that various modifications and alterations are possible within the scope of the invention as defined in the appended claims.

What is claimed is:

1. A closure for a transportable container, the closure comprising a collar portion arranged to lock with and be dockable with a port located in a wall of a process area to form a sealed connecting chamber, a lid portion removably connected to the collar portion, such that following locking of the closure with the port, the lid portion is removable from within the process area to provide communication between the interiors of the container and the process area, the collar and lid portions being so formed and shaped that all surfaces thereof which form part of the sealed connecting chamber lie in use in the direct path of sterilizing ultra-violet or pulsed white light radiation generated within the chamber with no surface or portion of a surface being shadowed from the radiation, the lid portion includes a grip member grippable to assist removal of the lid portion from the collar portion without generation of particulate material and in that all external surfaces of the grip member lie in use in the direct path of the sterilizing radiation; a junction between the lid and collar portions comprising a thin, frangible web or material defining a fracture line between the lid and collar portions and the grip member is disposed so that when it is pulled in a direction away from the collar portion, the web or material is caused to break along the fracture line to release the lid portion from the collar portion.

2. A closure according to claim 1, in which the lid portion is bonded to or integrally formed with the collar portion.

3. A closure according to claim 1 which is fabricated from a plastic material.

4. A closure according to claim 1 in which the collar portion is formed with an exterior surface which tapers towards the junction with the lid portion.

5. A closure according to claim 1 in which the lid portion has a planar surface which covers the mouth of the collar and which faces the port in use.

6. A closure according to claim 5, in which the grip member is associated with the planar surface.

7. A closure according to claim 1 in which the lid has a rim, and the grip member is disposed about at least a portion of the rim of the lid portion.

8. A closure according to claim 1 which the collar is provided with a flange which is sealingly connectable to a surface of the container.

9. A closure according to claim 8, in which the flange extends radially outwardly from the collar portion.

10. A closure according to claim 9, in which the flange is formed integrally with the collar portion.

11. A closure according to claim 8, in which the flange has a planar surface which is sealingly connectable to a planar surface of the container.

12. A closure according to claim 8, in which the flange is adapted to be welded together with the container.

13. A closure according to claim 1 including a sensor means connectable with a sensory device provided in the port.

14. A closure for a transportable container, the closure comprising a collar portion arranged to lock with and be dockable with a port located in a wall of a process area to form a sealed connecting chamber, a lid portion removably connected to the collar portion, such that following locking of the closure with the port, the lid portion is removable from within the process area to provide communication between the interiors of the container and the process area, the collar and lid portions being so formed and shaped that all surfaces thereof which form part of the sealed connecting chamber lie in use in the direct path of sterilizing ultra-violet or pulsed white light radiation generated within the chamber with no surface or portion of a surface being shadowed from the radiation, the lid portion includes a grip member grippable to assist removal of the lid portion from the collar portion without the generation of particulate material and in that all external surfaces of the grip member lie in use in the direct path of the sterilizing radiation;

the collar portion is formed with an exterior surface which tapers towards the junction with the lid portion; the lid portion has a rim, and the tapered exterior surface continues over and beyond the junction by the provision of a matching taper on the outer surface of the rim of the lid portion.

15. A closure for a transportable container, the closure comprising a collar portion arranged to lock with and be dockable with a port located in a wall of a process area to form a sealed connecting chamber, a lid portion removably connected to the collar portion, such that following locking of the closure with the port, the lid portion is removable from within the process area to provide communication between the interiors of the container and the process area, the collar and lid portions being so formed and shaped that all surfaces thereof which form part of the sealed connecting chamber lie in use in the direct path of sterilizing ultra-violet or pulsed white light radiation generated within the chamber with no surface or portion of a surface being shadowed from the radiation, the lid portion includes a grip member grippable to assist removal of the lid portion from the collar portion without the generation of particulate material and in that all external surfaces of the grip member lie in use in the direct path of the sterilizing radiation; the lid has a rim, and the grip member is disposed about at least a portion of the rim of the lid portion; the grip member is substantially triangular in cross-section, one side of the triangle comprising a tapered outer surface of the lid rim.

* * * * *